US008113029B2

(12) United States Patent
Lorbach

(10) Patent No.: US 8,113,029 B2
(45) Date of Patent: Feb. 14, 2012

(54) DROP FORGING METHOD AND FORGING DEVICE FOR CARRYING OUT SAID METHOD

(75) Inventor: Wolfgang Lorbach, Haan (DE)

(73) Assignee: KNIPEX-Werk C. Gustav Putsch KG (DE)

( * ) Notice: Subject to any disclaimer, the term of this patent is extended or adjusted under 35 U.S.C. 154(b) by 566 days.

(21) Appl. No.: 11/443,839

(22) Filed: May 31, 2006

(65) Prior Publication Data

US 2006/0266093 A1 Nov. 30, 2006

Related U.S. Application Data

(63) Continuation of application No. PCT/EP2004/053189, filed on Dec. 1, 2004.

(30) Foreign Application Priority Data

Dec. 1, 2003 (DE) ..... 103 56 258
Jun. 11, 2004 (DE) ..... 10 2004 028 378

(51) Int. Cl.
*B21J 13/10* (2006.01)

(52) U.S. Cl. ..... 72/361; 72/405.09; 72/405.12; 72/405.13; 72/422

(58) Field of Classification Search ..... 72/361, 72/362, 405.09, 405.12, 405.13, 421, 422, 72/426

See application file for complete search history.

(56) References Cited

U.S. PATENT DOCUMENTS 1,996,819 A 5/1932 Dean ..... 78/99
3,713,320 A * 1/1973 Andresen ..... 72/361
3,772,906 A * 11/1973 Dorton ..... 72/374
4,227,394 A * 10/1980 Heimel ..... 72/356
4,557,135 A * 12/1985 Ragettli et al. ..... 72/420
4,586,365 A * 5/1986 Henkelmann ..... 72/405.13

(Continued)

FOREIGN PATENT DOCUMENTS

DE 28 32 987 4/1979

(Continued)

OTHER PUBLICATIONS

International Search Report, Mar. 21, 2005, 3 pages.

(Continued)

*Primary Examiner* — Dmitry Suhol
(74) *Attorney, Agent, or Firm* — St. Onge Steward Johnston & Reens LLC

(57) ABSTRACT

The invention relates a drop forging method by means of a forging device provided with a hammer and a forging die, wherein a part placed in the forging die is shaped with a hammer blow, several engravings are formed in the die, a blank is initially inserted into the first engraving and said blank is moved along the other engravings to the last engraving, and then said blank picked up during shaping by a forging gripper. In order to obtain an optimum operating mode, the invention is characterized in that the part is received in a plurality of engravings with each hammer blow. In order to obtain a symmetrical distribution of the hammer load between occupied and non-occupied engravings, the parts are gripped respectively during shaping by the forging grippers. After each hammer blow, a successive displacement of the parts is carried out in the other engravings by removing the part from the last engraving or from the last but one by an engraving occupied by a part and a blank is inserted in the first engraving to be occupied.

23 Claims, 8 Drawing Sheets

U.S. PATENT DOCUMENTS

| | | | | |
|---|---|---|---|---|
| 4,671,095 | A * | 6/1987 | Brignoli | 72/403 |
| 6,382,010 | B2 * | 5/2002 | Stamm | 72/356 |
| 2001/0002548 | A1 * | 6/2001 | Stamm | 72/405.08 |
| 2006/0123871 | A1 * | 6/2006 | Reissenweber et al. | 72/306 |
| 2006/0169017 | A1 * | 8/2006 | Bauersachs et al. | 72/311 |

FOREIGN PATENT DOCUMENTS

| | | | |
|---|---|---|---|
| DE | 31 29 482 | A1 | 2/1983 |
| DE | 33 23 359 | | 1/1985 |
| DE | 199 58 846 | A1 | 6/2001 |
| DE | 203 11 306 | U1 | 10/2003 |
| JP | 1-258838 | | 10/1989 |

OTHER PUBLICATIONS

Dr. Ing. Stefan Erxleben, Dipl.-Ing. Lothar Bauersachs, "Automatisches Schmieden mit Gesenkschmiedehämmern", *Schmiede-Journal*; Sep. 2003; pp. 18-20.

"MassivUmformen", *Gräbener Pressen-Systeme*; pp. 1-24, 2001.

"Umformen Schneiden Prägen mit dem Gräbener-PressCenter", *Gräbener Pressen*; pp. 1-11, 1995.

Dr. Ing. Detlev Elsinghorst, "Präzisions-Schmiedehammer", *Schmiede-Journal*; Sep. 1997; p. 26 f.; pp. 1-2.

Dipl.-Ing. Axel Wittig, "Neue mechanische Schmiedepresse von Müller Weingarten"; pp. 1, Mar. 2000.

* cited by examiner

DROP FORGING METHOD AND FORGING DEVICE FOR CARRYING OUT SAID METHOD

CROSS-REFERENCE TO RELATED APPLICATIONS

The present application is a continuation of pending International patent application PCT/EP2004/053189 filed on Dec. 1, 2004 which designates the United States and claims priority from German patent application Nos. 10 2004 028 378.8 filed Jun. 11, 2004 and 103 56 258.3 filed Dec. 1, 2003, the contents of which are incorporated herein by reference.

FIELD OF THE INVENTION

The invention relates to a drop forging method, with a forging device having a ram and a die, a part lying in the die being shaped by a hammer blow, a plurality of impressions also being formed in the die, and a blank first being placed into a first impression and subsequently passing successively through further impressions to a final impression, and furthermore the part being gripped during the shaping by a forging gripper.

BACKGROUND OF THE INVENTION

During forging, it has long been the custom to hold the part to be forged by means of gripping tongs. Even when the method is carried out with a forging device having a ram and a die, that is to say with a hammer, the part lying in the die is held by means of a forging gripper. This prevents the workpiece from shifting in the impression. When the method is carried out by means of hammers, after forging by the first impression, the part lying in the die is successively placed in the following impression if a number of impressions are provided, until the part to be forged has passed through the further impressions to the final impression. In the case of such forging devices formed as hammers, the kinetic energy of the ram is used for shaping the workpieces. Examples of hammers that are used as forging hammers are drop hammers, hydraulic hammers and also counterblow hammers.

Apart from the forging devices formed as hammers, forging presses are known, in which the compressive forces are transmitted by means of a path-controlled press ram. These allow good forging results to be achieved, albeit also with relatively high initial costs. Moreover, not such high numbers of cycles per unit of time can be achieved as in the case of a forging hammer.

There is known from DE 31 29 482 C2 a forging press with a plurality of impressions formed one adjacent the other in the direction of passing through. Automatic transport of the workpieces is effected, but when a workpiece has been placed into an impression, the transporting device is withdrawn, that is to say is separated from the tool, while the forging operation is carried out. A comparable method and a comparable forging press are known from DE 199 58 846 A1. In this connection, it is also generally known from DE 33 23 359 C2 to handle forged parts automatically in a forging method. To be specific, here it is proposed to forge on an auxiliary body, which may be used for the engagement of transporting tongs and for the accurate positioning of a forged part in an impression.

On the basis of a forging method that is performed on a forging hammer, as presupposed at the beginning, the invention is concerned in first instance with the object of providing a drop forging method with a forging device having a ram and a die which, while making use of the generally more advantageous initial costs and high achievable numbers of cycles of such a device, nevertheless makes a high degree of automation possible, without having to accept disadvantages in the forging quality that is customary for such devices.

Furthermore, the invention is also concerned with the object of providing a drop forging device, with a ram and a die, which, while making use of the advantageous initial costs of such a device, makes forging with a high degree of automation and high achievable numbers of cycles possible, without having to accept disadvantages in quality.

SUMMARY OF THE INVENTION

With regard to the method, the stated object is achieved first and foremost in the case of the subject matter of claim 1, it being provided that, for every hammer blow, a part is accommodated in a plurality of impressions, with symmetrical distribution between occupied and unoccupied impressions with regard to loading of the ram, the parts being respectively gripped during shaping by the forging gripper, and after every hammer blow a successive displacement of the parts into a further impression being performed, with a part being removed from the final impression or the last impression that is occupied by a part before the final impression, and the blank being placed into the first impression to be occupied. It is preferred that, for every hammer blow, a part is accommodated in each impression, which part is respectively gripped during the shaping by the forging gripper and after every hammer blow is successively displaced into the adjacent impression toward the final impression. In this process, a part is in each case also removed from the final impression and a further part is placed into the first impression. However, even with the method described here, it is possible, as explained in principle for a forging press in the already cited DE 31 29 482 C2, always to skip certain impressions, including in an alternating manner, so that all the impressions are occupied in a specific rhythm, but not simultaneously; this while paying attention to the most uniform loading possible, as desired with regard to a ram, to keep the guides in good condition. It is pertinent that according to the method described here, the hammer is always loaded virtually uniformly. This not only results in less loading of the guides, but also has advantageous effects on the quality of the forged piece. The method is here carried out in a way that is known in principle to this extent, with the forged pieces being constantly gripped. As a result of the described uniform loading of the forging hammer, not only are the guides found to become less worn, but also the forging offset on the forged pieces is not increased in comparison with known methods, but even generally reduced.

The described method is preferably suitable for forging forged parts such as the halves of pliers. In principle, however, it is also suitable for other forged parts; in particular for such parts as have a greater length than width. These may, for example, also be parts such as connecting rods or camshafts.

If the method is carried out on a forging device having two guide pillars, forming a double-stand type of construction, there is the possibility that the parts accommodated by the impressions are disposed one adjacent the other in a connecting line of the guide pillars and are successively displaced on this connecting line. The die is then aligned in the same way as in customary methods that are known per se. However, by contrast, it is ensured in the case of the method according to the invention that, with the hammer blow, a multiplicity of impressions are occupied, in a symmetrical way with regard to the loading of the ram, and not just one impression as in the prior art. An advantageous alternative according to the invention is that of designing the method in such a way that the parts to be forged, or "blanks", run in over as short a path as possible and can be set down at the end of the forging operation without changing their position. For this purpose, the impressions are disposed one adjacent the other in a series lying transversely in relation to a connecting line of the guide pillars, and the parts are successively advanced in the direction of this side-by-side arrangement. The parts themselves consequently lie in the connecting line or parallel to it. This specifically takes the form that the parts removed from the final impression and/or placed into the first impression are introduced and/or discharged in a direction parallel to the direction of passing through. According to the invention, it is appropriate in this respect that, on the transporting device reaching right up to the forging device, the parts introduced and/or discharged are heat-treated by means of a heating system associated with said transporting device. The forged parts are consequently brought to the required temperature necessary for working the parts. To allow the successive displacement of the parts to be advantageously performed, the parts are in any case transported in the die from impression to impression by simultaneous raising and setting down at their opposite end regions. For example, this may take place by means of crank ejectors from impression to impression or from cavity to cavity. The end regions of the parts are used to grip onto the parts. Access to the parts takes place from below. Troublefree implementation of the method results from the fact that the transporting rhythm of the parts is synchronized with the forging frequency. Then the method according to the invention allows the same part to be forged two or more times in an impression of the same form, these impressions being separate from one another and passed through one following after the other in the direction of passing through. Identical and non-identical impressions are therefore provided in irregular sequence. With regard to the possibility of only occupying some of the impressions, albeit in a symmetrical manner, for every hammer blow, it is therefore also possible for a number of identical impressions to be provided one adjacent the other or in symmetrical sequence in relation to one another, as required by the working steps themselves. The forging of one and the same part two or more times in impressions of the same form can lead for example to a better surface and to greater dimensional accuracy.

The forging device may still be constructed in the tried-and-tested manner. By occupying the impressions with parts in a symmetrical manner with regard to the loading, or occupying all the impressions with parts, the guides are uniformly loaded. During the return movement of the ram after each hammer blow, the parts lying simultaneously in all the impressions, apart from a part lying in the final impression or the last impression that is occupied before the final impression, are transported at the same time into the adjacent or next-provided impression in the direction of passing through. The die may form at least two impressions of the same form one adjacent the other. Furthermore, the die having the impressions positioned one adjacent the other may have a different alignment in relation to the connecting line of the guide pillars. In particular, there are two possibilities for this. One possibility is that the impressions are disposed one adjacent the other in a connecting line of the guide pillars. On the other hand, the impressions may also be disposed in a series one adjacent the other transversely in relation to the connecting line of the guide pillars. An advantageous configuration is distinguished by providing a transporting device for the parts to be placed into the first impression and/or to be removed from the final impression, with a transporting direction parallel to the direction of passing through. This alignment allows the transporting device for introducing and/or discharging the parts to reach right up to the forging device and allows the transporting device to have in the region of introduction and/or discharge a heating system for heat-treating the parts. To allow the parts to be moved from one impression into the other, the die has a conveying mechanism for raising, conveying and setting down the parts from impression to impression by engaging opposite end regions of the parts. This conveying mechanism is coordinated with the operating mode of the ram, so that a transporting rhythm of the parts that is synchronized with the forging frequency can be obtained.

Independently of whether all the impressions or only some of the impressions are occupied with a part, in a symmetrical manner, for every hammer blow, it is preferably provided with regard to the transporting device that a forging and transporting gripper is associated with every impression irrespective of the occupation with each hammer blow.

With regard to the tool costs and the mode of operation, it proves to be of advantage for the forging and/or transporting grippers to be disposed outside a base area of the die. Both the die and the forging and/or transporting grippers represent modules that are independent of one another, so that each can itself be optimally configured. The use of a forging hammer instead of a forging press brings the advantage of low-cost construction of the forging device. In particular, use of a drop hammer as the hammer is commended. This means that, when there is movement of the ram toward the forged piece, acceleration due to gravity takes effect, while raising takes place by means of a lifting member. According to the invention, the hammer may be a counterblow hammer. In this case, the lower ram and upper ram move counter to each other, so that losses of energy due to impact and propagation of the impact in the floor are avoided entirely. The forging and transporting grippers would then have to be disposed at an appropriate level to be associated with the forging tools. The counterblow hammers may even help to simplify the gripping and conveying mechanism, because they offer more space. Such counterblow hammers are of advantage in particular for the forging of crankshafts. Also to be emphasized is the fact that the forged part is constantly gripped during forging, whether by the forging gripper or the transporting gripper. If this gripping takes place by the transporting gripper, the latter even performs a dual function. With regard to its association with the hammer, advantages are obtained in that the guide pillars have at the level of the lower die a recess facing the die for receiving the forging and/or transporting grippers. Moreover, the grippers are configured in such a way that the geometry of the gripping ends, changing during a forging blow, or their alignment, can be taken into account. For this purpose, the forging grippers may for example have pivotally suspended gripping heads or resiliently yielding gripping heads. Up to a certain extent, slipping of the blanks in the gripping ends may also be tolerated. Finally, it must also be emphasized that the forging and/or transporting grippers may be formed in such a way that they are hammer-resistant. On account of this, it is of advantage that the forging and/or transporting grippers move in concert with the movement of the forging hammer with every forging blow.

BRIEF DESCRIPTION OF THE DRAWINGS

Several exemplary embodiments of the invention are explained below with reference to the drawings, in which.

DETAILED DESCRIPTION OF THE INVENTION

Figure 1:
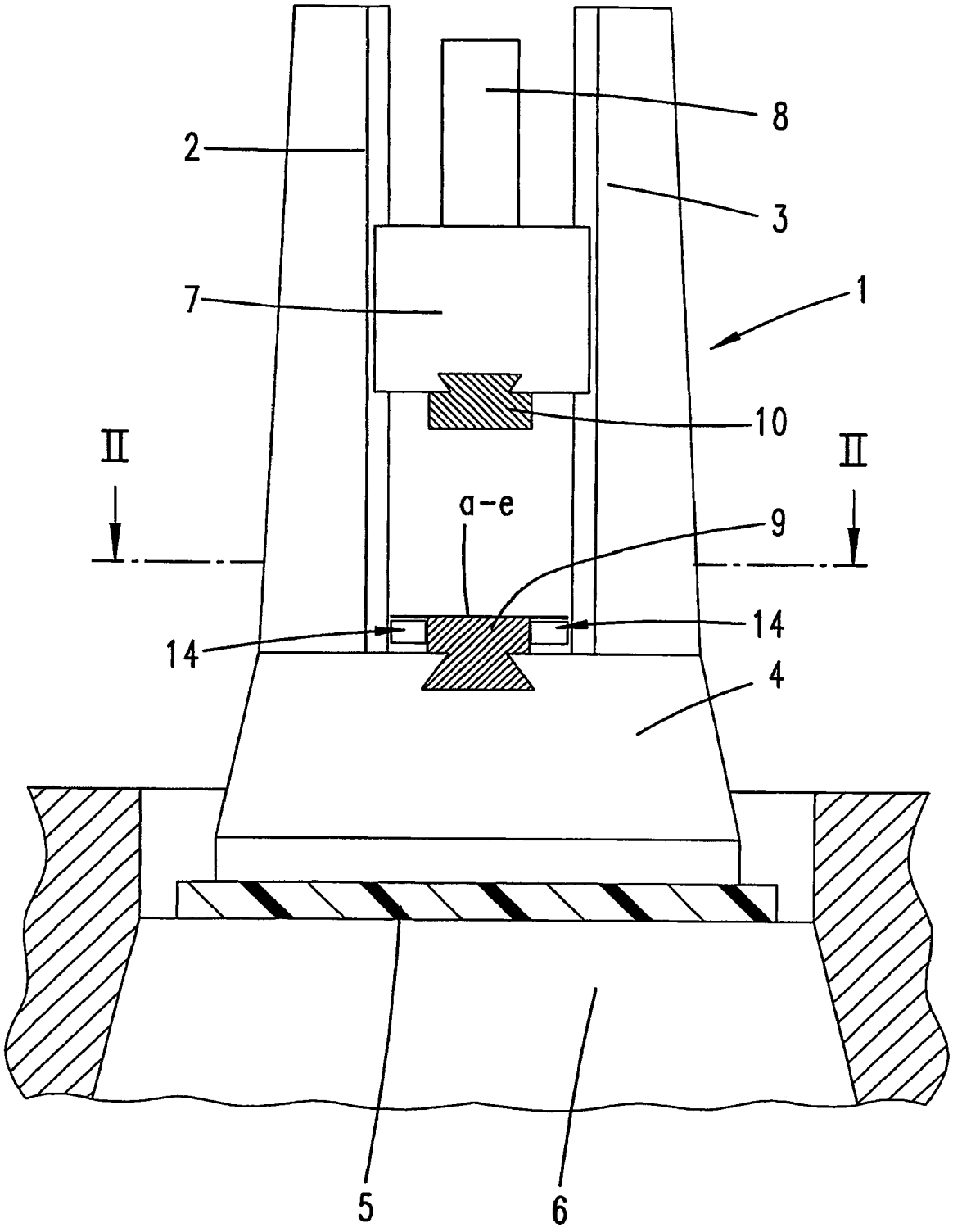
FIG. 1 shows a view of a forging device according to the first embodiment for carrying out the method.

The exemplary embodiments are described with regard to carrying out the method in such a way that a part is accommodated in every impression for every hammer blow.

According to the first embodiment as shown in FIGS. 1 to 4, the forging device for carrying out the method is designated by the number 1. The forging device 1 has two guide pillars 2, 3, disposed parallel to each other. The latter extend from an anvil block or a base plate 4, which for its part is supported on a foundation 6 by means of an intermediate layer 5.

The guide pillars 2, 3 accommodate between them a ram 7, which can be moved in the vertical direction and is engaged by a drive 8.

Between the pillars 2, 3, the base plate 4 carries a lower die 9, which can be secured there by means that are not represented. Opposite the lower die 9, the ram 7 is provided on its underside with an upper die 10.

The die 9 has a rectangular outline and forms on its upper side a plurality of impressions a, b, c, d and e, positioned one adjacent the other. The impression a is the first impression and the impression e is the final impression. The impressions a to e serve for accommodating parts T to be shaped. The direction of passing through x of the parts placed into the impressions a to e runs transversely in relation to the connecting line of the guide pillars 2, 3. It is provided for the impressions a to e to be positioned one adjacent the other in such a way that they are generally spaced equally from one another. When there is a hammer blow, the opposing impressions (not represented) of the upper die that interact with the impressions a to e lead to shaping of the parts T placed in the impressions a to e.

As can be seen from the plan view representation, when the forging device 1 is in operation, a blank R is placed into the first impression a. After being placed into the first impression a, this blank therefore represents a part T to be shaped. Serving for introducing and discharging the parts T is a transporting device 11, 12, which reaches right up to the forging device and is formed by two sections. The transporting device 11 reaches up to the side of the die 9, which forms the first impression a. The transporting device 12 is adjacent the final impression e. The finished forged parts are conveyed away on it. This means that the parts placed into the first impression a and the parts removed from the final impression e are introduced and discharged in a direction parallel to the direction of passing through x the die 9. If appropriate, removal of the finished forged parts can also take place by a differently configured transporting device.

Figure 2:
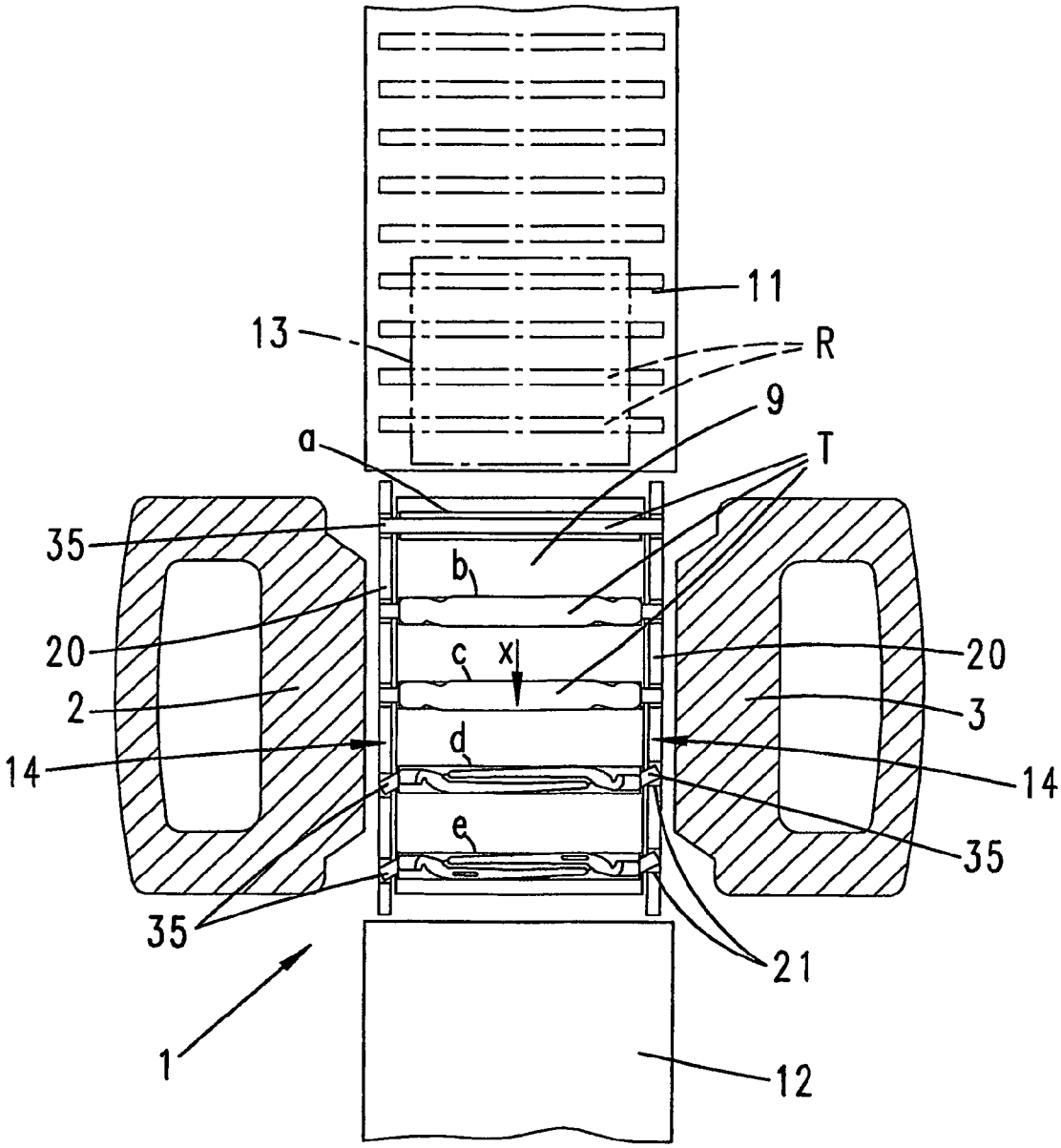
FIG. 2 shows a section along the line II-II in FIG. 1 in a schematic representation.
Figure 3:
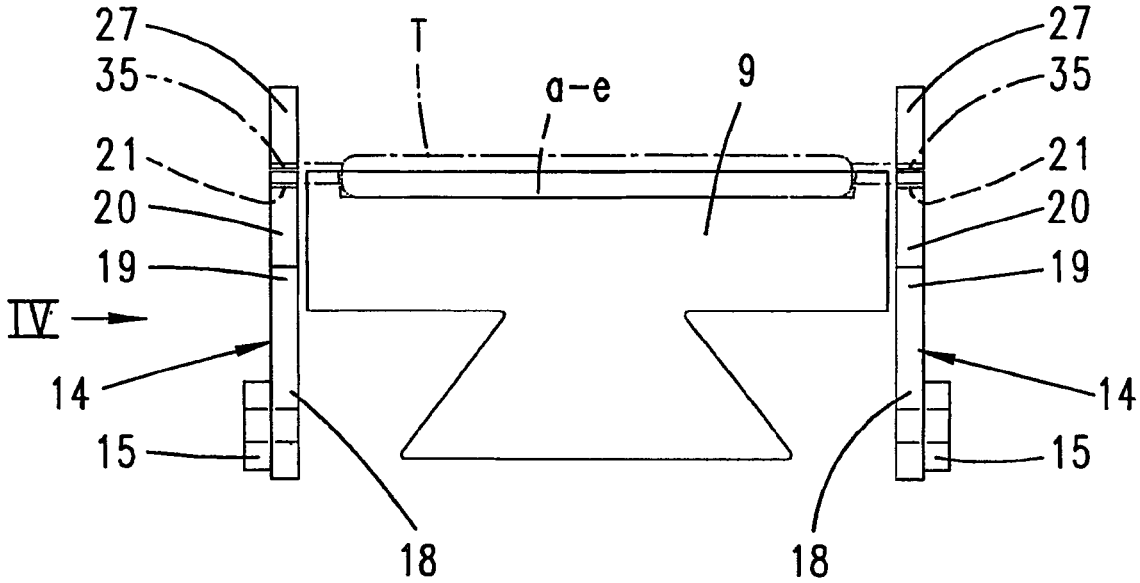
FIG. 3 shows a schematic representation of the lower die in front view.
Figure 4:
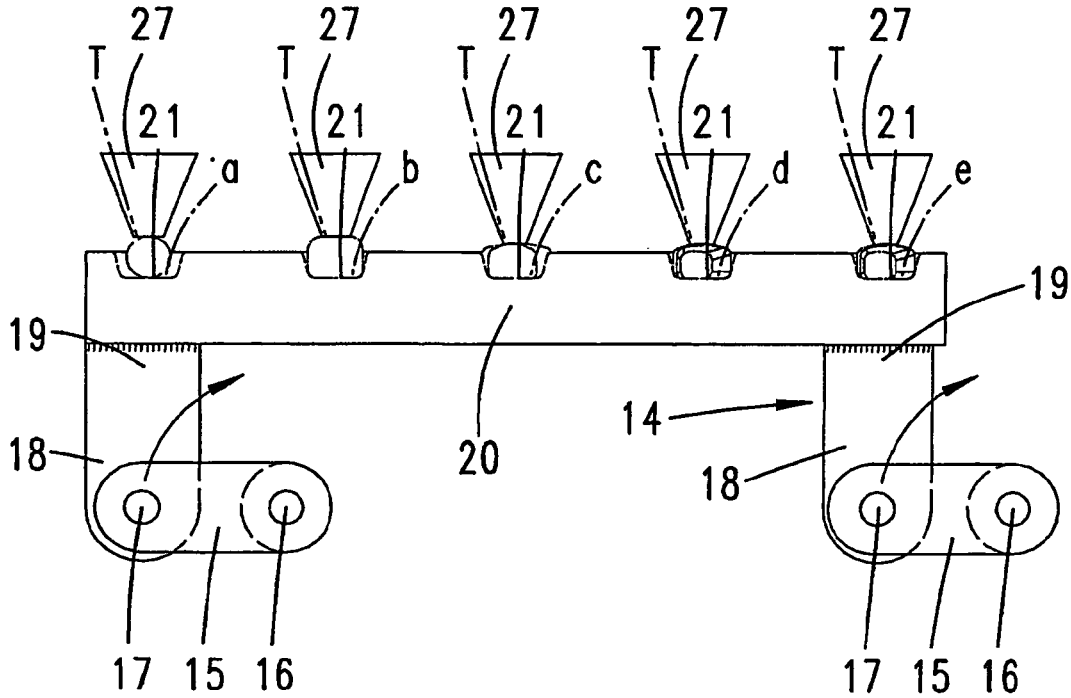
FIG. 4 shows the view according to the direction of arrow IV in FIG. 3.

It can be seen from FIG. 2 that a heating system 13, indicated by dashed-dotted lines, is associated with the transporting device 11 reaching right up to the forging device 1. This ensures that the blanks are always at the requisite temperature when they are placed into the first impression a. The use of a heating system would also be possible on the transporting device 12, in order to heat-treat the finished forged parts for possible further processing.

It can be seen from the plan view representation according to FIG. 2 that, starting from the first impression a, the parts placed into the impressions a to e are continuously brought into the final form in the impression e. In the case of the exemplary embodiment, the impressions a to e are configured in such a way that halves of pliers, as are used in water pump pliers, can be forged in them. For example, the impressions b and c may be configured in the same form, so that the same part T is forged twice in an impression of the same form. As can be gathered from the drawing, these two impressions b and c are passed through one following after the other in the direction of passing through.

The longitudinal extent of the impressions a to e runs in a transversely directed manner in relation to the longitudinal sides of the die 9. A conveying mechanism 14 is associated with each longitudinal side. These mechanisms are identical in their construction, so that only one is explained below. Each conveying mechanism 14 has two pivotally mounted crank arms 15 with pivot axes 16 aligned parallel to the impressions a to e. One crank arm 15 is adjacent the first impression a and the other adjacent the final impression e. Mounted on crank pins 17 that are provided on the crank arms 15 are links 18, which for their part are fixed by their link end 19 on a conveying bar 20 guided in the longitudinal direction outside the die 9. Consequently, two conveying bars 20 are provided, moving close to the longitudinal sides of the die 9.

After starting the forging device, the state in which all the cavities or impressions a to e are occupied with parts T is obtained. This leads to uniform loading of the ram 7 occurring with a hammer blow, which has advantageous effects on the guiding of the ram and to a great extent does not cause any forging offset of the parts that undergo the deformation. In the same way, this has advantageous effects on the guiding of the die. During a hammer blow, the conveying bars 20 are in a corresponding position, compare FIG. 4. In this position, the parts T lie with their opposite end regions 35 in upwardly open transporting indentations 21 of the guiding bars 20. In addition, deployed abutments 27 act on the end portions 35 of the parts T, configured as gripping ends. During the return stroke of the ram 7, the conveying bars 20 are raised by pivotal displacement of the crank arms 15 in the indicated pivoting direction following retraction of the abutments 27, and consequently the parts T are lifted out from their impressions a to e in order to be placed into the adjacent impression in the direction of passing through. This does not apply to the part lying in the final impression e, since this is then associated with the discharging transporting section 12. At the same time as this operation, a new blank, coming from the transporting section 11, is placed into the first impression a. In this way, for every hammer blow, all the impressions are each loaded with a part, which parts successively pass through the die. To allow this to be carried out in a troublefree manner, the transporting rhythm of the parts is synchronized with the forging frequency.

Figure 5:
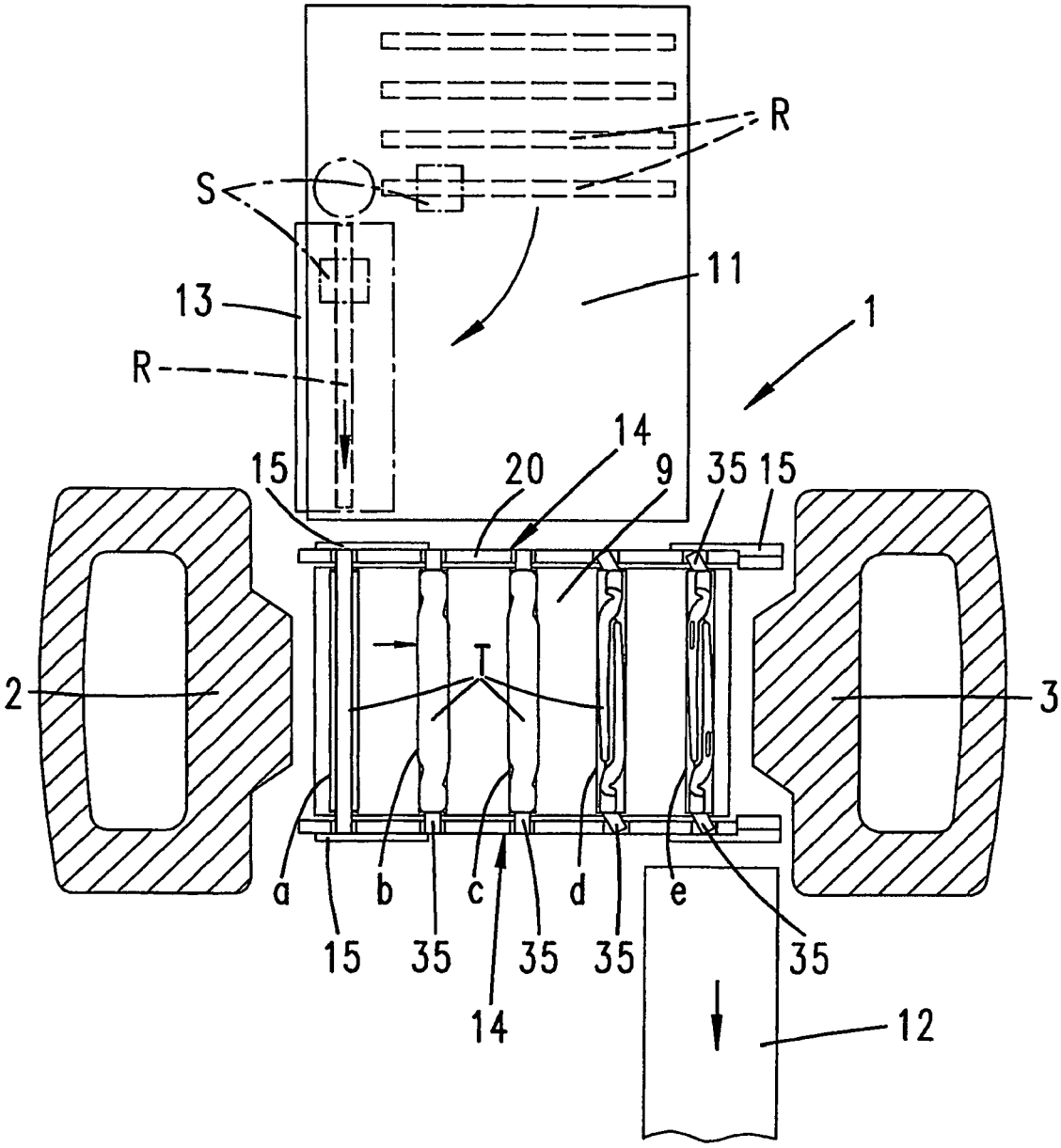
FIG. 5 shows a forging device according to the second embodiment in schematic plan representation.

According to the second embodiment as shown in FIG. 5, the same components have the same reference numerals. As a departure, the impressions a to e of the die 9' are now disposed one adjacent the other in a connecting line of the guide pillars 2, 3. This means that the parts accommodated by the impressions are successively displaced on this connecting line during the forging.

A transporting mechanism 11 similar to in the case of the previous embodiment is then provided. To allow the first blank R in the conveying direction to be transferred as intended to the first impression a, a turning station S is associated with the transporting mechanism 11, which station in each case turns the corresponding blank R through 90° in accordance with the forging frequency and allows it to be pushed into the first impression a. Also provided in this version is a heating system 13, by means of which the blanks delivered to the forging device 1 are brought to the requisite temperature.

Also represented in this version is a transporting mechanism 12 for transporting the finished forged parts away.

Figure 6:
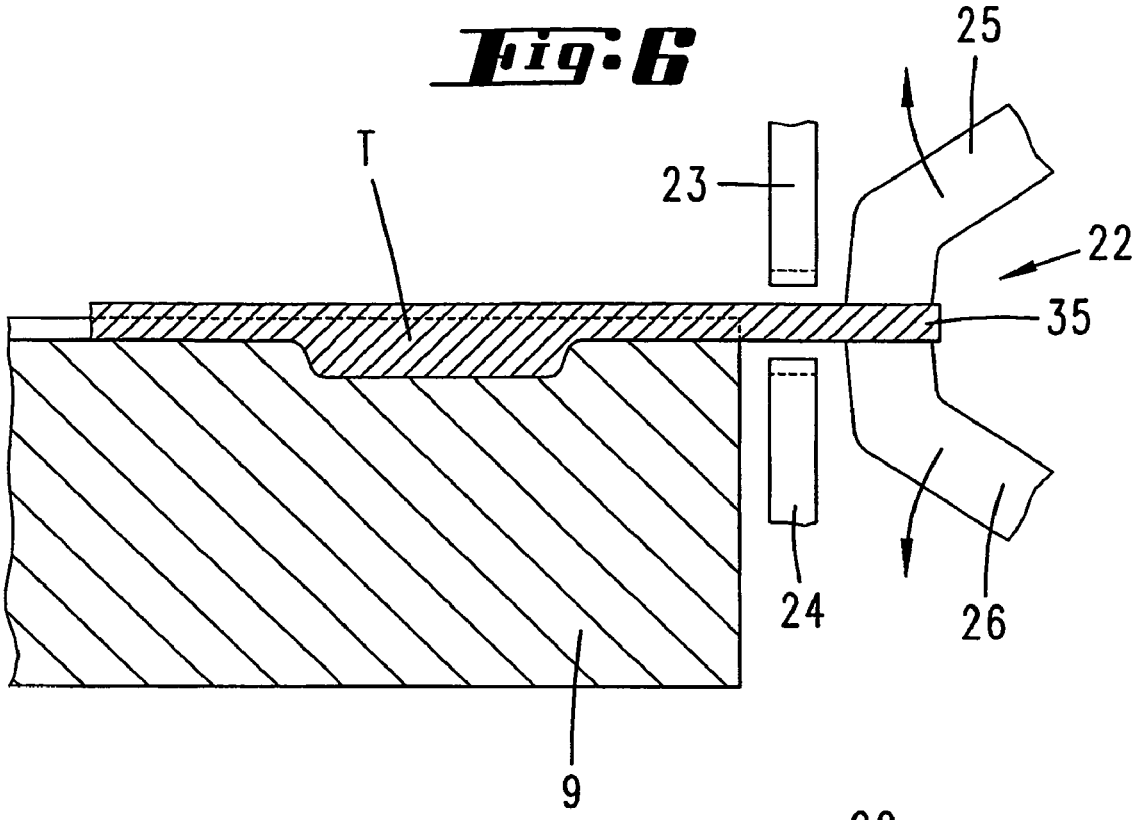
FIG. 6 shows a longitudinal section through an impression of a die with a modified conveying mechanism, operating on a double-tong principle, with a part still lying in the impression.
Figure 7:
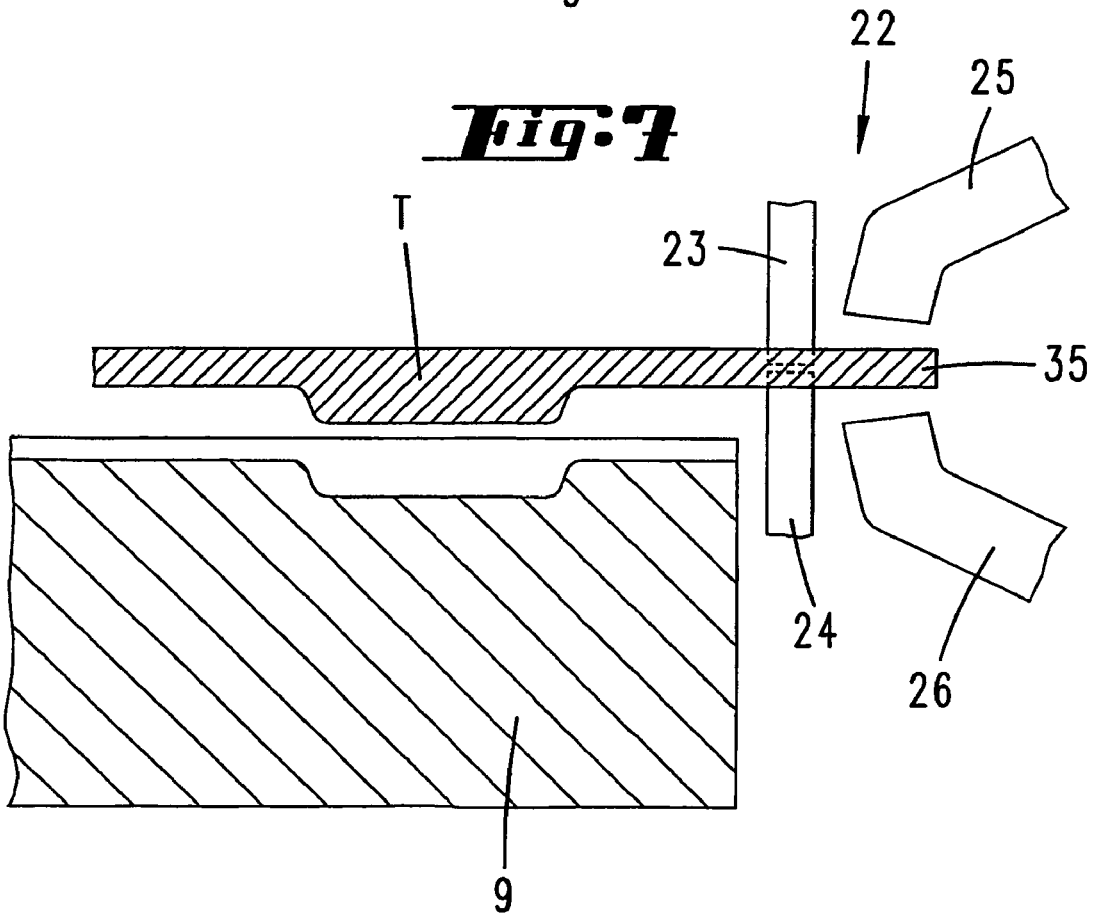
FIG. 7 shows a representation following on from FIG. 6, the part having been lifted out of the impression by means of the transporting tongs and the gripping tongs being located in their release position.

FIGS. 6 and 7 concern a modified configuration of conveying mechanism 22, associated with the die 9. This mechanism operates on the double-tong principle. Therefore, two transporting tongs 23, 24 are disposed positioned one above the other. The latter are adjacent the relevant side surface of the die. Projecting beyond this is the end 35 of the part T placed into an impression. On the other side of the transporting tongs 23, 24 are forging tongs 25, 26, which can likewise entering into gripping engagement with the end 35. While the forging tongs 25, 26 only perform an opening and closing movement according to the direction of the arrow, the transporting tongs 23, 24 can carry out a transporting movement along the side surface of the die in their closed position 23, 24.

To be specific, the conveying mechanism 22 operates as follows:

during the hammer blow, the gripping tongs 25, 26 grasp the end 35 of a part T lying in an impression, while the transporting tongs 23, 24 are released from the end 35 and are in a position away from the latter, cf. FIG. 6.

Once a hammer blow has taken place, the forging tongs 25, 26 open. This is accompanied by the forging tongs 23, 24 entering into a position of engagement with the end 35, so that subsequently the part T lifted out from the impression can be placed into an adjacent impression by means of the transporting tongs 23, 24 performing a conveying movement. During the opening of the transporting tongs 23, 24, the forging tongs 25, 26 then enter into engagement with the end 35.

Figure 8:
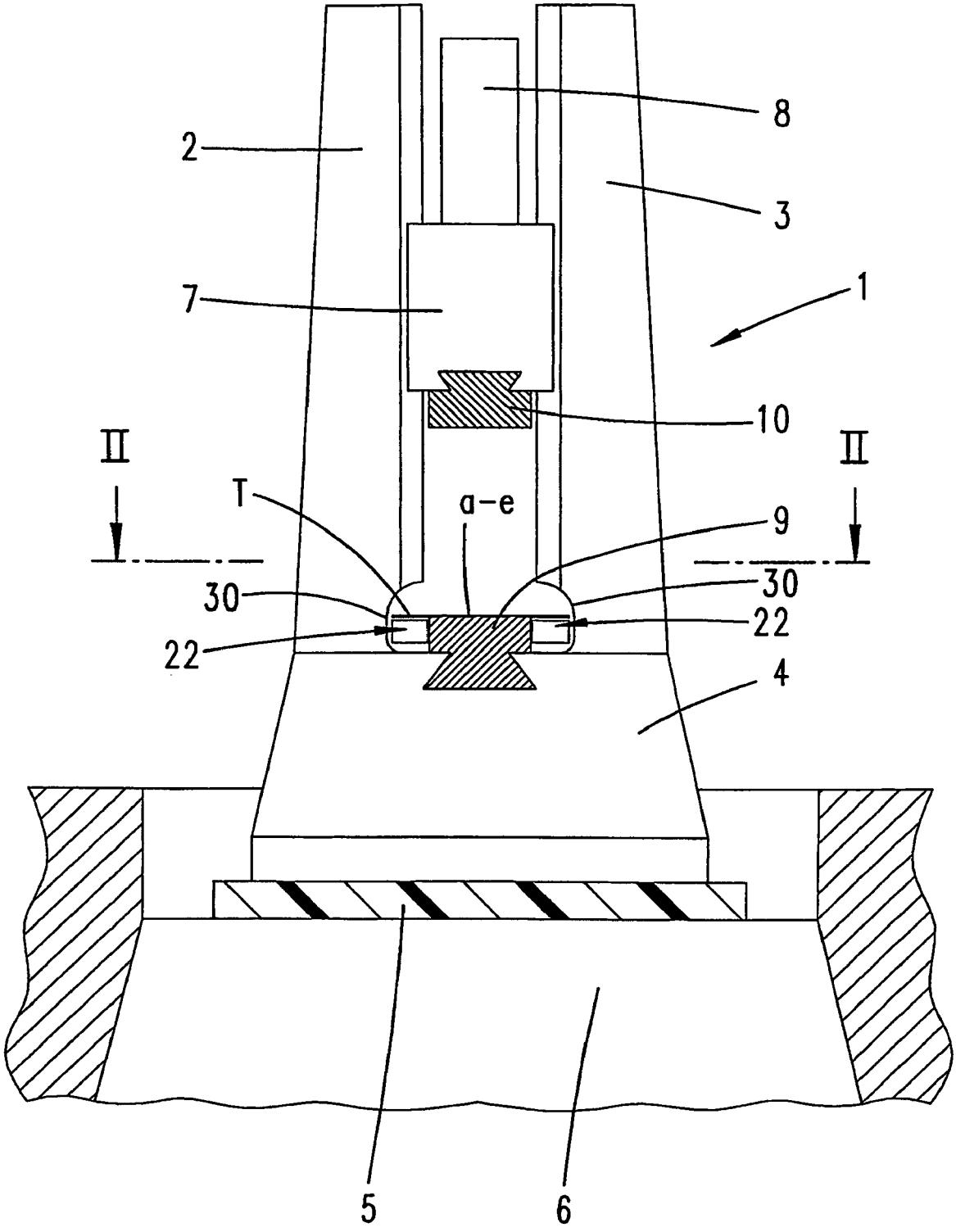
FIG. 8 shows a view comparable to FIG. 1 of the forging device according to the third embodiment.
Figure 9:
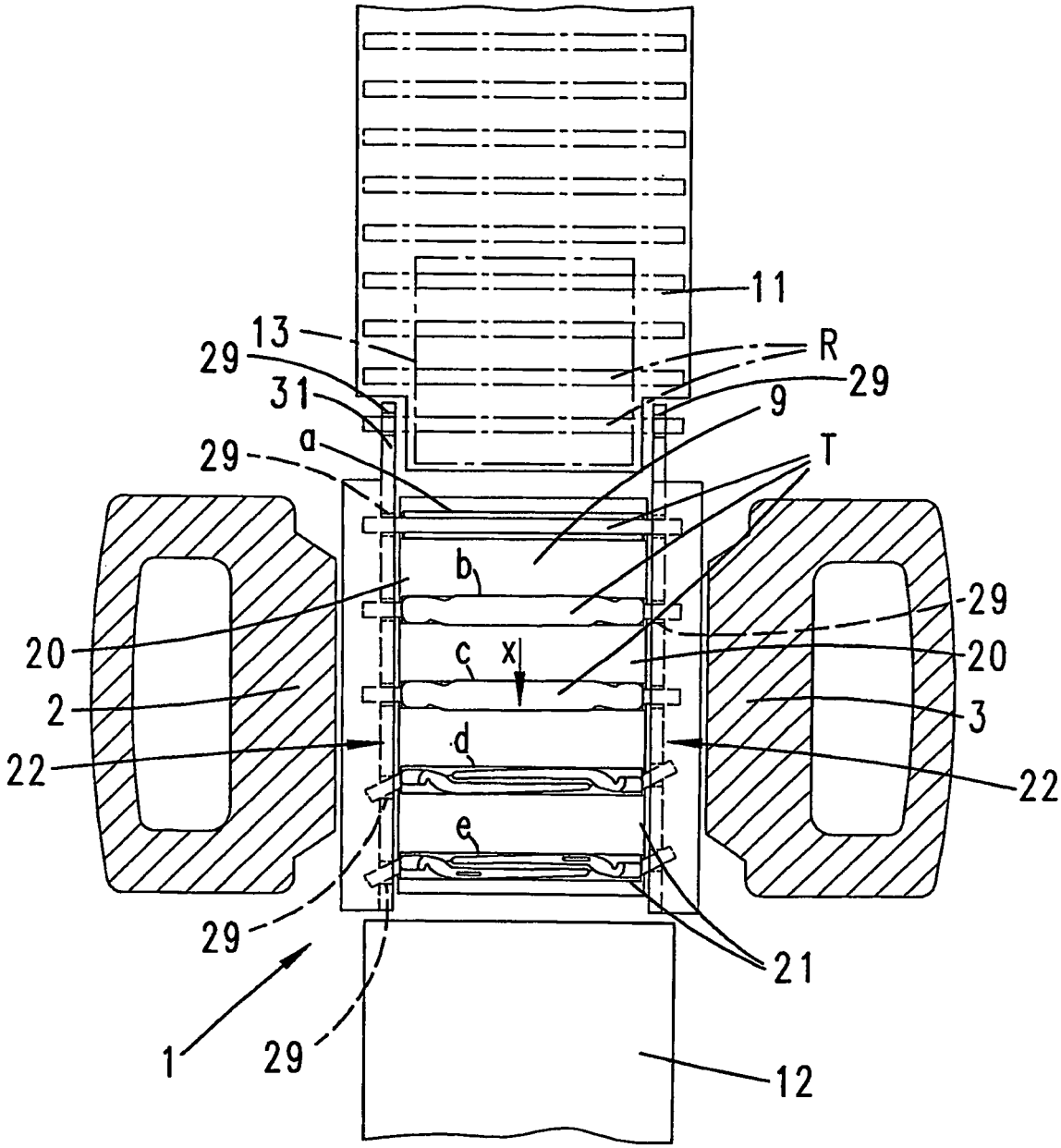
FIG. 9 shows a cross section through the forging device above the lower die.
Figure 10:
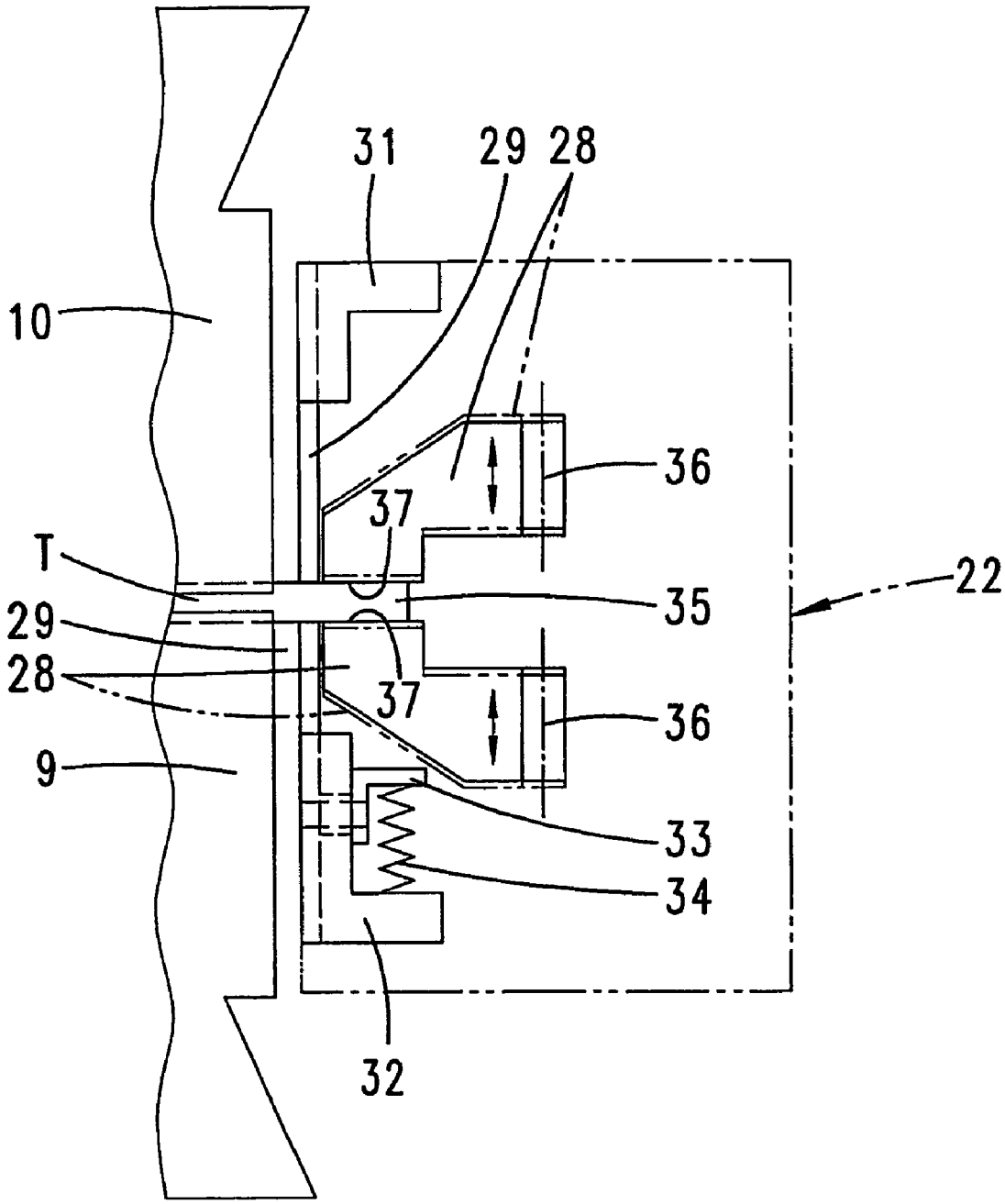
FIG. 10 shows a cross-sectional representation in the region of the transporting and forging grippers located in the position of engagement.

According to the third embodiment as shown in FIGS. 8 to 10, the same components have the same reference numerals.

As a departure from the first embodiment, forging grippers 28 and transporting grippers 29, forming a conveying mechanism 22, are now provided on both sides of the lower die 9. Furthermore, the guide pillars 2, 3 have level with the lower die 9 a recess 30 facing the latter for receiving the forging and transporting grippers 28, 29. The latter are formed in such a way that they are hammer-resistant and therefore move in concert with the forging device 1, which is configured as a forging hammer, with every forging blow. As also in the case of the first embodiment, the hammer is a drop hammer. As in the case of the first embodiment, the longitudinal extent of the impressions a to e then runs in a transversely directed manner in relation to the longitudinal sides of the die 9. Two transporting bars 31, 32, which are disposed one above the other and for their part are carriers of the transporting grippers 29, are associated with each longitudinal side. The transporting bars 31, 32 are controlled in such a way that they can perform a longitudinal movement in the direction in which the parts pass through. Furthermore, the transporting bars 31, 32 are displaceable toward each other. Both the lower die 9 and the upper die 10 are provided with five impressions a, b, c, d and e, lying one after the other. By contrast, six transporting grippers 29 respectively extend from the transporting bars 31, 32. The spacing of the transporting grippers 29 from one another corresponds to the spacing of the impressions from one another. It is therefore possible that grippers 29 associated with the introducing transporting section 11 can receive a part arriving there.

As can be seen from FIG. 10, the lower transporting grippers 29 are carriers of extension arms 33. Each extension arm 33 is supported by means of a compression spring 34 on the transporting bar 32. The spring excursion of the lower grippers 29 is designed in such a way that a small upward stroke can be carried out from the position of engagement with the ends 35 of the parts T, which ends 35 serve as gripping ends, thereby achieving a certain spring-loading effect.

Level with the impressions, two forging grippers 28 are associated with each of them. Each forging gripper 28 is displaceable in the direction of the double-headed arrow according to FIG. 10 and can accordingly be brought into the position of engagement with the gripping ends 35 of the parts. In addition, each gripper 28 is able to perform a pivoting movement about a vertical axis 36. The engagement surfaces 37 acting upon the gripping ends 35 run parallel to each other and are made smooth.

The transporting rhythm of the parts T is synchronized with the forging frequency. Control of the forging grippers 28 also takes place correspondingly, said grippers entering into a position of engagement with the gripping ends 35 from a release position—represented by dashed-dotted lines. Once this has taken place, the hammer blow is carried out by downward displacement of the ram 7, cf. FIG. 10. This means that the forged piece T is constantly gripped during the forging and is accordingly in a controlled position. During this operation, the transporting grippers 29 likewise remain in engagement with the gripping ends 35. However, it would also be possible for the transporting grippers 29 to assume a position away from the gripping ends 35 during the forging.

It can be seen in particular from FIGS. 9 and 10 that the ends of the blanks or parts T have a lateral projection beyond the die 9. The projections form the aforementioned gripping ends 35. The parts or blanks may be configured as round material. However, the use of flat material is also possible for example. It is then also possible for a certain mass distribution to be provided with respect to the blanks, that is to say a pre-deformation of the same.

It can be gathered from FIG. 9 that, with every forging blow, the geometry of the gripping ends 35 or their alignment changes. The forging grippers 28 are capable of allowing for such a change. If the geometry changes, the gripping ends 35 that are held with non-positive engagement by the forging grippers 28 between the abutment surfaces 37 slip into the corresponding position. It is therefore ensured that the forged pieces are nevertheless held in a controlled manner during the forging operation.

In addition, it is possible that, during the operation described above, the forging grippers 28 can pivot about the vertical axis 36, in order to obtain an adaptation or alignment of the gripping ends. In the release position of the forging grippers 28, the latter then return again to their starting position.

All disclosed features are (in themselves) pertinent to the invention. The disclosure content of the associated/accompanying priority documents (copy of the prior application) is also hereby incorporated in full in the disclosure of the application, including for the purpose of incorporating features of these documents in claims of the present application.

What is claimed is:

1. A drop forging method, comprising the steps of:

providing a drop forging device having a ram and a die, a plurality of impressions being formed in the die, and a plurality of parts lying in the impressions being shaped by a hammer blow from the ram;

placing a blank part into a first impression to be occupied after every hammer blow, wherein the blank part is subsequently passed through the further impressions to a final impression to be occupied;

dropping the ram to provide a hammer blow to the blank part and each of the plurality of parts lying in the impressions;

after every hammer blow, successively displacing each of the blank part and the plurality of parts through the further impressions and removing a part from the final impression or the last occupied impression;

gripping the plurality of parts constantly during the shaping and displacing by one of a forging tong and a transport tong, wherein the forging tongs and the transport tongs are disposed outside of the die and adjacent to longitudinal side surfaces of the die, wherein distal ends of the parts to be forged project beyond the longitudinal side surfaces, and wherein the transport tongs transport the parts along the longitudinal side surfaces of the die; and wherein, for every hammer blow, the plurality of parts are accommodated in the plurality of impressions, with symmetrical distribution between occupied and unoccupied impressions in the die with regard to loading of the ram, characterized in that the same part is forged two or more times in impressions having the same form, these impressions being separate from one another and passed through one following after the other in a direction of passing through.

2. The drop forging method according to claim 1 wherein, the forging device also having two guide pillars for the ram, between which the die is accommodated.

3. The drop forging method according to claim 2 characterized in that the impressions are disposed one adjacent the other in a series lying transversely in relation to a connecting line of the guide pillars, and the parts are successively displaced in the direction of this side-by-side arrangement.

4. The drop forging method according to claim 1, wherein the forging device also having two guide pillars for the ram, between which the die is accommodated, characterized in that the impressions are disposed one adjacent the other in a connecting line of the guide pillars and the parts are successively displaced on the connecting line.

5. The drop forging method according to claim 1 characterized in that the part removed from the final impression or the last occupied impression is discharged, and the blank part placed into the first impression are introduced, in a direction parallel to a direction of the parts passing through the die.

6. The method according to claim 5 characterized in that, on a transporting device reaching right up to the forging device, the introduced and/or discharged parts are heat-treated by means of a heating system associated with said transporting device.

7. The method according to claim 1 characterized in that the parts are in each case transported in the die from impression to impression by simultaneous raising and setting down at their opposite end regions.

8. The method according to claim 7 characterized in that a transporting rhythm of the parts is synchronized with a forging frequency.

9. A drop forging device, comprising:

a ram for providing a hammer blow when dropped;

a die including a plurality of impressions being formed in the die and a plurality of parts lying in the impressions being shaped by the hammer blow;

a conveying device by means of which the parts can be moved from one impression to the next being associated with the die, characterized in that the conveying device is designed in such a way that, after every hammer blow, the parts lying simultaneously in all the impressions, apart from the part lying in a final impression, are transported at the same time into an adjacent impression in a direction of passing through;

one or more forging tongs constantly gripping each of the plurality of parts during the forging; and one or more transport tongs gripping each of the plurality of parts during the moving of the parts from one impression to the next, wherein the forging tongs and the transport tongs are disposed outside of the die and adjacent to longitudinal side surfaces of the die, wherein distal ends of the parts to be forged project beyond the longitudinal side surfaces, and wherein the transport tongs transport the parts along the longitudinal side surfaces of the die, characterized in that the drop forging device forges includes two or more impressions having the same form, wherein said drop forging device forges the same part two or more times in the impressions having the same form, these impressions being separate from one another and passed through one following after the other in a direction of passing through.

10. The forging device according to claim 9, having two guide pillars for the ram, between which the die is accommodated, characterized in that the impressions are disposed one adjacent the other in a connecting line of the guide pillars.

11. The forging device according to claim 9, having two guide pillars for the ram, between which the die is accommodated, characterized in that the series of impressions disposed one adjacent the other runs transversely in relation to a connecting line of the guide pillars.

12. The forging device according to claim 9, characterized by a transporting device for the parts to be placed into a first impression and/or to be removed from the final impression, a transporting direction parallel to the direction of passing through being provided.

13. The forging device according to claim 12, characterized in that the transporting device for introducing and/or discharging the parts reaches right up to the forging device and the transporting device has in the region of introduction and/or discharge a heating system for heat-treating the parts.

14. The forging device according to claim 9, characterized in that the die includes a conveying mechanism for raising, conveying and setting down the parts from impression to impression by engagement on opposite end regions of the parts.

15. The forging device according to claim 14, characterized by a transporting rhythm of the parts that is synchronized with a forging frequency.

16. The forging device according to claim 9, characterized in that the ram is a drop hammer.

17. The forging device according to claim 9, characterized in that the ram is a counterblow hammer.

18. The forging device according to claim 9, having two guide pillars characterized by a recess level with a lower die and facing the lower die for receiving the forging tongs and the transport tongs.

19. The forging device according to claim 9, characterized in that a forging and/or transporting grippers are formed in such a way that they are hammer-resistant.

20. A drop forging method, comprising the steps of:

providing a drop forging device having a ram and a die, a plurality of impressions being formed in the die, and a plurality of parts lying in the impressions being shaped by a hammer blow from the ram;

placing a blank part into a first impression to be occupied after every hammer blow, wherein the blank part is subsequently passed through the further impressions to a final impression to be occupied;

dropping the ram to provide a hammer blow to the blank part and each of the plurality of parts lying in the impressions;

after every hammer blow, successively displacing each of the blank part and the plurality of parts through the further impressions and removing a part from the final impression or the last occupied impression;

gripping the plurality of parts constantly during the shaping and displacing by one of a forging tong and a transport tong; and wherein, for every hammer blow, the plurality of parts are accommodated in the plurality of impressions, with symmetrical distribution between occupied and unoccupied impressions in the die with regard to loading of the ram;

characterized in that the same part is forged two or more times in impressions having the same form, these impressions being separate from one another and passed through one following after the other in a direction of passing through.

21. A drop forging device, comprising:

a ram for providing a hammer blow when dropped;

a die including a plurality of impressions being formed in the die and a plurality of parts lying in the impressions being shaped by the hammer blow;

a conveying device by means of which the parts can be moved from one impression to the next being associated with the die, characterized in that the conveying device is designed in such a way that, after every hammer blow, the parts lying simultaneously in all the impressions, apart from the part lying in a final impression, are transported at the same time into an adjacent impression in a direction of passing through;

one or more forging tongs constantly gripping each of the plurality of parts during the forging; and one or more transport tongs gripping each of the plurality of parts during the moving of the parts from one impression to the next;

characterized in that at least two impressions of the same form are be formed one adjacent the other in the die; and characterized in that said drop forging device forges the same part two or more times in the impressions of the same form, these impressions being separate from one another and passed through one following after the other in a direction of passing through.

22. A drop forging method, comprising the steps of:

providing a drop forging device having a ram and a die, a plurality of impressions being formed in the die, and a plurality of parts lying in the impressions being shaped by a hammer blow from the ram;

placing a blank part into a first impression to be occupied after every hammer blow, wherein the blank part is subsequently passed through the further impressions to a final impression to be occupied;

dropping the ram to provide a hammer blow to the blank part and each of the plurality of parts lying in the impressions;

after every hammer blow, successively displacing each of the blank part and the plurality of parts through the further impressions and removing a part from the final impression or the last occupied impression;

gripping the plurality of parts constantly during the shaping and displacing by one of a forging tong and a transport tong; and characterized in that the same part is forged two or more times in impressions having the same form, these impressions being separate from one another and passed through one following after the other in a direction of passing through.

23. A drop forging device, comprising:

a ram for providing a hammer blow when dropped;

a die including a plurality of impressions being formed in the die and a plurality of parts lying in the impressions being shaped by the hammer blow;

a conveying device by means of which the parts can be moved from one impression to the next being associated with the die, characterized in that the conveying device is designed in such a way that, after every hammer blow, the parts lying simultaneously in all the impressions, apart from the part lying in a final impression, are transported at the same time into an adjacent impression in a direction of passing through;

one or more forging tongs constantly gripping each of the plurality of parts during the forging; and one or more transport tongs gripping each of the plurality of parts during the moving of the parts from one impression to the next;

characterized in that the drop forging device forges includes two or more impressions having the same form, wherein said drop forging device forges the same part two or more times in the impressions having the same form, these impressions being separate from one another and passed through one following after the other in a direction of passing through.

* * * * *